United States Patent [19]

Wisniewski

[11] 4,327,461

[45] May 4, 1982

[54] FURNITURE GLIDE AND FURNITURE

[75] Inventor: Joseph M. Wisniewski, Marne, Mich.

[73] Assignee: Steelcase Inc., Grand Rapids, Mich.

[21] Appl. No.: 47,096

[22] Filed: Jun. 11, 1979

[51] Int. Cl.[3] ..... A47B 91/06

[52] U.S. Cl. ..... 16/42 R; 248/188.9

[58] Field of Search ..... 16/42 R, 42 T, 30; 248/188.9

[56] References Cited

U.S. PATENT DOCUMENTS

| | | | |
|---|---|---|---|
| 1,839,593 | 1/1932 | Rice | 16/42 R |
| 2,135,945 | 11/1938 | Miller | 16/42 R |
| 2,860,368 | 11/1958 | Thornsbury | 16/42 T |
| 2,875,552 | 3/1959 | Stillman | 248/188.9 |

FOREIGN PATENT DOCUMENTS

| | | | |
|---|---|---|---|
| 2513484 | 10/1975 | Fed. Rep. of Germany | 16/42 R |
| 1201195 | 7/1959 | France | 248/188.9 |

*Primary Examiner*—Andrew V. Kundrat

*Attorney, Agent, or Firm*—Price, Heneveld, Huizenga & Cooper

[57] ABSTRACT

The specification discloses a glide within a glide, and most preferably three glides in one which enables the manufacturer to supply two or three different types of glides with one basic glide unit having common parts. The first glide member is made of hard plastic and has a rounded, bottom shoulder surrounding a downwardly opening cavity therein. A second glide member comprises a soft, plastic member seated within said cavity and projecting a short distance below said rounded shoulder, at least when the glide is unweighted. A third glide member comprises a metal cap which seats over the second glide member and against first glide member to provide a metal bottom surface type of glide.

32 Claims, 9 Drawing Figures

FURNITURE GLIDE AND FURNITURE

BACKGROUND OF THE INVENTION

The present invention relates to furniture glides. Several different types of glides are commonly available. The present invention also relates in a unique way to modular seating which is often ganged together by some type of mechanical interconnecting means.

The hard plastic glide is commonly used on chairs. Its hard plastic surface engages the floor and allows a chair to be slid over the floor. Yet, it tends not to scratch or mar the floor. Some type of fastener is joined to the hard plastic member to facilitate its securance to an article of furniture.

Soft rubber glides are used primarily for desks or other articles of furniture which are to be permanently located. A rubber member typically projects from a metal shell which in turn includes a screw post projecting upwardly therefrom which facilitates securance of the glide to a desk leg or the like. The soft rubber is a high friction material and minimizes sliding of the article.

A third type of glide is a variation of the hard plastic glide and comprises a hard surface defined by a rounded metal member. Typically, the metal member is chrome plated. The advantage of such a member over a hard plastic is that it has less tendency to pick up sand and grit and thereby become abrasive.

The present invention also relates to modular seating which normally has to be ganged together by some sort of ganging means. I conceived of using soft, high friction glides on such an article of seating to replace the ganging means. It was thought that the high friction glides would prevent the various articles of modular seating from moving relative to one another, thereby eliminating the need for some sort of mechanical ganging device for interconnecting the units.

However, the soft rubber glides typically used on desks are not suitable for articles of seating. Compression of the soft rubber or sliding wear on the soft rubber caused by even unintentional sliding would tend to result in the sharp edges of the metal shell gouging the floor surface.

Purchasers of furniture usually specify one or the other of the above glides or else settle for whatever particular type of glide the manufacturer has offered. When purchasing modular seating for ganging purposes, the manufacturer must provide some sort of mechanical ganging device. The concept of using a friction glide in place of a ganging means has not heretofore been conceived of to my knowledge.

SUMMARY OF THE INVENTION

The present invention comprises at least a glide within a glide whereby a user gets at least two types of glides with one glide assembly. The user can pick and choose in the field whichever variation he wishes. The glide of the present invention includes a soft friction glide, but positioned within another hard structural glide member such that the tendency for the soft structural member to wear out is somewhat minimized and such that even if it does wear out, there are no exposed sharp edges to gouge the floor.

Accordingly, in addition to providing a "glide within a glide" which offers flexibility to the user, the present invention also offers a glide which can be used in modular seating and which can in many applications replace mechanical ganging means for interconnecting the same. Further, in its most preferred aspect, the present invention comprises actually three glides in one. These and other objects, features and advantages of the invention will be more fully understood and appreciated by reference to the written specification and appended drawings.

DESCRIPTION OF THE PREFERRED EMBODIMENT

The furniture glides 1 of the preferred embodiment are shown attached to the base runner 2*c* of a base support 2 for an article of modular seating. In addition to runner 2*c*, base support 2 includes a front leg 2*a* and a rear leg 2*b*. In a modular seating system, there would be various alternative seating units available with two or more such base supports 2 secured thereto. Typically, users locate two or more such units immediately adjacent one another and mechanically interconnect them by "ganging means".

Figure 2:
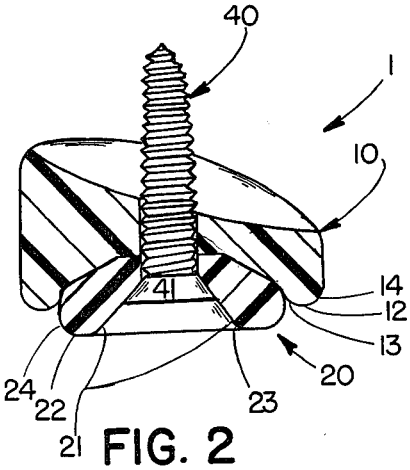
FIG. 2 is a cross sectional view of the glide of the present invention.
Figure 7:
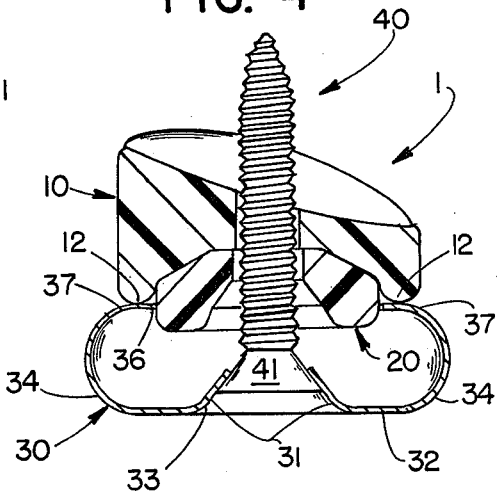
FIG. 7 is a cross sectional view showing the glide assembly of the present invention with the metal cap alternative in place.
Figure 8:
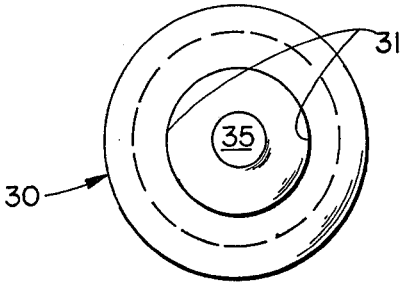
FIG. 8 is a bottom plan view of the metal cap.

Each preferred embodiment glide 1 comprises a hard glide member 10 with a soft glide member 20 positioned therein and projecting therefrom (FIG. 2). The resulting glide 1 is secured to an article of furniture by a screw fastener 40. Glide 1 may alternatively include a metal cap 30 as shown in FIG. 7.

Figure 3:
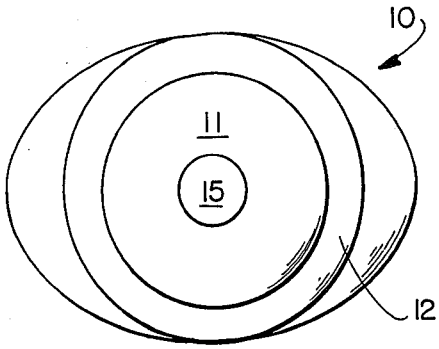
FIG. 3 is a bottom plan view of the hard plastic glide component of the present invention.
Figure 4:
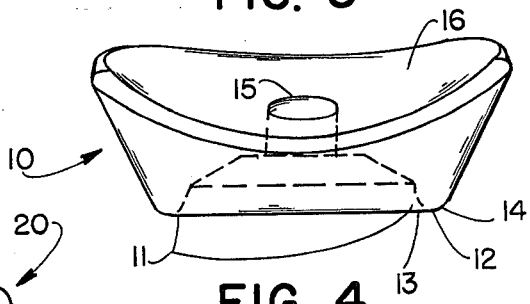
FIG. 4 is a side elevational view of the hard plastic glide component.

Hard glide member 10 includes a downwardly opening bottom cavity 11 within which soft glide member 20 is seated (compare FIGS. 2, 3 and 4). Cavity 11 is surrounded by a bottom shoulder 12 which has a rounded inner bottom edge 13 adjacent cavity 11 and a rounded outer bottom edge 14 spaced therefrom. In this way, hard glide member 10 offers no cutting edges which could gouge a floor upon which glide member 10 might be seated.

A hole 15 extends from the base of interior cavity 11 up through the top of hard glide member 10 such that screw 40 can be passed thereto. If glide member 10 alone were used, the head 41 of screw 40 would seat in cavity 11. As shown in the preferred embodiment, hard glide member 10 also includes a concave upper mounting surface 16 which is shaped to conform to the generally oval shaped cross sectional configuration of runner 2*c* of furniture support 2.

Hard glide 10 is preferably molded of a hard rigid, structural plastic material capable of supporting an article of furniture in various use modes, including sliding, without significant visible deformation. Because it is hard, glide member 10 is a sliding glide, offering little friction against the surface on which it rests.

Preferably, hard plastic glide member 10 is molded of a polycarbonate material. A material having a Rockwell hardness of between 60 and 80 on the "M" Scale or in excess of 100 on the "R" Scale is preferable. A particularly desirable polycarbonate is sold under the trademark "Merlon M50" by Mobay Chemical Company. That material has a tensile strength to yield of approximately 9,500 lbs. per square inch. It has a tensile modulous of approximately 3.3 times $10^5$ lbs. per square inch and a flexural strength to yield of approximately 12,500 lbs. per square inch. Its flexural modulous is approximately 3 times $10^5$ lbs. per square inch. Its compressive strength is approximately 10,500 lbs. per square inch. Its Rockwell hardness is specifically 62 on the "M" Scale.

Figure 5:
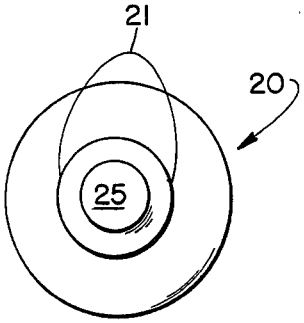
FIG. 5 is a bottom plan view of the soft plastic glide component of the glide.
Figure 6:
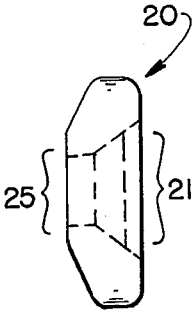
FIG. 6 is a side elevational view of the soft plastic glide component.

Soft glide member 20 has a configuration such that its seats within cavity 11 in hard glide member 10 (FIG. 2). It too includes a downwardly opening central cavity 21 designed to accommodate the head 41 of screw 40 (compare FIGS. 2, 5 and 6).

Surrounding screw head cavity 21 is a downwardly projecting shoulder 22 for engaging the floor. Preferably, the generally arcuate shoulder 22 includes a radiused inner bottom edge 23 and a radiused outer bottom edge 24. It also includes a hole 25 extending from the base of interior cavity 21 through the top thereof such that the shank of screw 40 can pass therethrough.

Soft glide member 20 is made of a relatively soft, compressible, pliable plastic material such that it will frictionally engage the floor surface. Such a material should be formulated so as to have a durometer of between about 70 and about 100 on the Shore A scale. It will tend to prevent an article of furniture from sliding on the floor surface.

A preferable plastic material is a polyethelenevinyl acetate copolymer. Specifically, a preferred copolymer comprises approximately 28% vinyl acetate although somewhat more and somewhat less can be employed satisfactorily. The most preferred compound for molding soft glide member 20 is sold under the trade designation "Alathon EVA 3175" by DuPont. It has an ultimate tensile strength at room temperature of only 2,000 pounds per square inch. Its ultimate percent elongation at room temperature is 800%. It has a stiffness of only 1,770 psi at room temperature as determined by ASTM standard test D-747. Its dynamic coefficient of friction to stainless steel is 2.2 as determined by ASTM standard test D-1894.

Metal cap 30 (FIG. 7) is designed to seat over soft glide member 20 and abut the shoulder 12 of hard glide member 10 (FIG. 7). It is preferably made of a steel material of sufficient thickness and strength that its hollow configuration will not collapse when it is weighted by an article of furniture. It includes a recessed cavity 31 adapted to receive the head 41 of screw 40. Cavity 31 is surrounded by a bottom shoulder 32 which is arcuate in configuration and which engages the floor surface. Bottom shoulder 32 has a rounded inner bottom edge 33 and a rounded outer bottom edge 34 such that there are no sharp edges to gouge the floor on which shoulder 32 is seated. Preferably, the entire surface of shoulder 32 is slightly rounded.

There is a hole 35 through the bottom of cavity 31 such that screw 40 will pass therethrough. The entire top of metal cap 30 is open in view of the fact that it seats around soft glide member 20.

More specifically, metal cap member 30 includes a rolled over upper shoulder 37 which terminates at top edge 36. Top edge 36 is positioned in abutment with or closely adjacent to the perimeter of the side walls of soft glide member 20. Top shoulder 37 is seated generally against the bottom shoulder 12 of hard glide member 10.

In its most preferred embodiment, the glide 1 of the present invention can be supplied to the customer with metal cap 30, soft glide 20 and hard plastic glide 10, all in position as shown in FIG. 7. If the user prefers a frictional engagement between the floor surface and the article of furniture he simply removes screw 40 and metal cap 30 and then reinserts screw 40 such that only soft plastic glide member 20 is in position as shown in FIG. 2. If the user prefers only a hard plastic glide, he can remove screw 40, remove soft plastic glide 20 and resecure hard glide member 10 to the article of furniture with screw 40.

The combination of hard glide member 10 and soft glide member 20 as illustrated in FIG. 2 is particularly useful in connection with articles of seating. Soft glide member 20 is designed to project only a short distance below the bottom extreme of shoulder 12 of hard glide member 10. Soft glide member 20 will compress upwardly into the cavity 11 in hard glide member 10 when glide assembly 1 is weighted. In this way, hard glide member 10 helps to hold soft glide member 20 against excessive flexing when the article of furniture is unintentionally moved, as occurs when a person sits in an article of seating.

Most preferably, soft plastic glide 20 compresses so that it is generally completely within cavity 11 when an article of seating is sat upon by a typical user. To achieve this result for the particular configuration of hard glide member 10 and soft glide member 20 shown and considering the particular material of which the preferred embodiment soft glide 20 is made of, I have found that soft slide member 20 should project approximately 1/16th of an inch below the bottom level of shoulder 12 of hard glide member 10. In this way, soft glide member 20 as well as shoulder 12 of hard glide member 10 will be engaging the floor surface when a user is sitting on a chair. The contact of soft glide member 20 will tend to prevent the article of seating from sliding. Yet because soft glide member 20 is completely surrounded by the structural, hard glide member 10, there will be less tendency for soft glide member 20 to flex one way or the other as the user wiggles about in the article of seating. Thus, wear and tear on soft glide member 20 will tend to be minimized.

Even if wear on soft glide member 20 becomes excessive, the floor on which glide 1 is seated will not be gouged. Hard glide member 10 is designed so that it in and of itself can serve as a furniture glide. Thus, its rounded bottom shoulder 12 presents no sharp edges which can gouge the floor.

Figure 9:
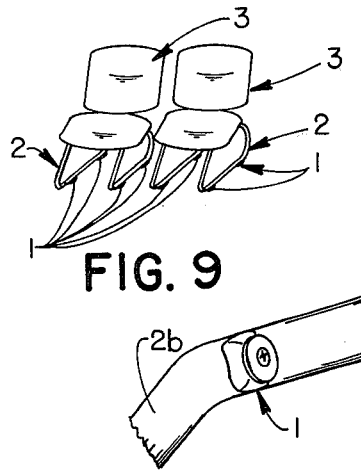
FIG. 9 is a perspective view of two modular seating units "ganged" close together through the use of the glides of the present invention.
Figure 1:
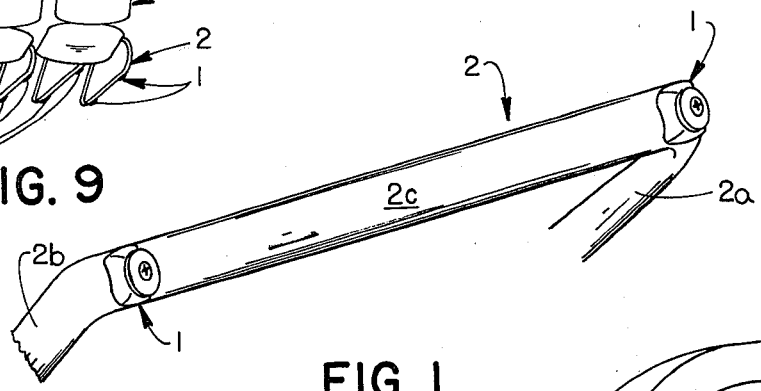
FIG. 1 is a generally bottom, fragmentary view showing glides made in accordance with the present invention positioned on the bottom runner of a base support for modular seating.

As a result of the embodiment of the present invention as illustrated in FIG. 2 in particular, modular seating can be provided without any ganging system. The articles of seating 3 can be placed in closely adjacent fashion as one normally would when ganging them together (FIG. 9). Yet they will be held in that position due to the frictional engagement of soft glide member 20 against the floor surface. Of course, it is understood that the above are preferred embodiments of the invention and that various changes and alterations can be made without departing from the spirit and broader aspects thereof as set forth in the appended claims, which are to be interpretted in accordance with the principles of patent law.

The embodiments of the invention in which an exclusive property or privilege is claimed are defined as follows:

1. A furniture glide for an article of furniture, comprising:

a first glide member made of a hard, rigid structural material capable of supporting an article of furniture on a floor surface in various use modes, including sliding over the floor surface without significant deformation; said first glide member including a downwardly opening cavity therein, and a downwardly facing shoulder adapted for abutment with the floor surface; said shoulder having a radiused bottom, whereby said first glide member will not dig into the floor surface, and can function as a glide in and of itself;

a second glide member shaped to be abuttingly seated within said cavity and having a bottom projecting a short distance below the bottom of said shoulder of said first glide member at least when said furniture glide is unweighted; said second glide member having a downwardly extending aperture therethrough to facilitate fastening to the furniture article, and being made of a relatively soft, high friction material which will tend to prevent an article of furniture employing said glide from sliding over the floor surface on which it is supported; and fastener means for selectively connecting said first and second glide members both to the article of furniture and to each other; said fastener means being adapted to extend through said second glide member aperture, and comprising a head shaped for a recessed fit therein, and a shank with means for detachably connecting said glide with the article of furniture, whereby said glide has a non-sliding use mode wherein said first and second glide membes are matingly interconnected and attached to the furniture article by said fastener means, and a sliding use mode wherein said second glide member is detached from said first glide member, and said first glide member is connected directly to the furniture article by said fastener means.

2. The glide of claim 1 wherein said second glide member is made of a material sufficiently compressable that it compresses at least partially into said cavity in said first glide member when said glide is weighted.

3. The furniture glide of claim 2 wherein said second glide member is made of a material sufficiently compressive that when affixed to an article of seating, it compresses generally completely into said cavity in said first glide member when said article of seating is weighted with a person or persons seated thereon, but still projects below said shoulder of said first glide member when weighted only by the unoccupied article of seating.

4. The furniture glide of claim 1, 2 or 3 in which said first glide member is made of a hard plastic material and said second glide member is made of a soft plastic material.

5. The glide of claim 4 wherein said first glide member is made of a hard plastic material having a Rockwell hardness of from about 60 to about 80 on the "M" Scale; and said second glide member is made of a soft plastic having a durometer of between about 70 and about 100 on the Shore A Scale.

6. The glide of claim 5 wherein said hard plastic material is a polycarbonate and said soft plastic material is a polyethelene-vinyl acetate copolymer.

7. The glide of claim 1 wherein said fastener means comprises a threaded screw.

8. The glide of claim 1 or 7 which includes a metal cap having rounded bottom edges whereby said metal cap will not gouge a floor on which it is seated;

said metal cap fitting over said projecting portions of said second glide member;

said metal cap including a top shoulder which engages said shoulder on said first glide member; and means securing said metal cap to said first glide member.

9. The glide of claim 8 wherein said metal cap includes a downwardly opening cavity in the bottom thereof adapted to receive the head of a screw;

a hole extending through said metal cap generally at the base of said cavity whereby the shank of a screw will pass therethrough.

10. The furniture glide of claim 8 in which said first glide member is made of a hard plastic material and said second glide member is made of a soft plastic material.

11. The glide of claim 10 wherein said first glide member is made of a hard plastic material having a Rockwell hardness of from about 60 to about 80 on the "M" Scale; and said second glide member is made of a soft plastic having a durometer of between about 70 and about 100 on the Shore A Scale.

12. The glide of claim 11 wherein said hard plastic material is a polycarbonate and said soft plastic material is a polyethelene-vinyl acetate copolymer.

13. The furniture glide of claim 7 in which said first glide member is made of a hard plastic material and said second glide member is made of a soft plastic material.

14. The glide of claim 13 wherein said first glide member is made of a hard plastic material having a Rockwell hardness of from about 60 to about 80 on the "M" Scale; and said second glide member is made of a soft plastic having a durometer of between about 70 and about 100 on the Shore A Scale.

15. The glide of claim 14 wherein said hard plastic material is a polycarbonate and said soft plastic material is a polyethelene-vinyl acetate copolymer.

16. A modular seating furniture system comprising at least two articles of seating designed for location in immediate adjacency to one another;

each of said articles of seating being free of ganging means for joining same together;

each of said articles of seating including at least two glides for engaging the surface on which said articles of seating are positioned to prevent same from sliding relative to one another; each glide including:

a first glide member made of a hard, rigid structural material capable of supporting an article of furniture on a floor surface in various use modes, including sliding over the floor surface without significant deformation; said first glide member including a downwardly opening cavity therein, and a downwardly facing shoulder adapted for abutment with the floor surface; said shoulder having a radiused bottom, whereby said first glide member will not dig into the floor surface and can function as a glide in and of itself;

a second glide member shaped to be abuttingly seated within said cavity and having a bottom projecting a short distance below the bottom of said shoulder of said first glide member at least when said furniture glide is unweighted; said second glide member being made of a relatively soft, high friction material which will tend to prevent an article of furniture employing said glide from sliding over the floor surface on which it is supported;

means for selectively and detachably fastening said first and second glide members both to the article of furniture and to each other, whereby said glide has a non-sliding use mode wherein said first and second glide members are matingly interconnected and attached to the furniture article by said fastening means, and a sliding use mode wherein said second glide member is detached from said first glide member, and said first glide member is connected directly to the furniture article by said fastening means.

17. The modular seating system of claim 16 wherein said second glide member is made of a material sufficiently compressable that it compresses at least partially into said cavity in said first glide member when said glide is weighted.

18. The modular seating system of claim 17 wherein said second glide member is made of a material sufficiently compressive that when affixed to an article of seating, it compresses generally completely into said cavity in said first glide member when said article of seating is weighted with a person or persons seated thereon, but still projects below said shoulder of said first glide member when weighted only by the unoccupied article of seating.

19. The modular seating system of claim 17, or 18 in which said first glide member is made of a hard plastic material and said second glide member is made of a soft plastic material.

20. The modular seating system of claim 19 wherein said first glide member is made of a hard plastic material having a Rockwell hardness of from about 60 to about 80 on the "M" Scale; and said second glide member is made of a soft plastic having a durometer of between about 70 and about 100 on the Shore A Scale.

21. The modular seating system of claim 20 wherein said hard plastic material is a polycarbonate and said soft plastic material is a polyethelene-vinyl acetate copolymer.

22. The modular seating system of claim 16 wherein said fastening means comprises a threaded screw.

23. The modular seating system of claim 16 or 22 which includes a metal cap having rounded bottom edges whereby said metal cap will not gouge a floor on which it is seated;

said metal cap fitting over said projecting portions of said second glide member;

said metal cap including a top shoulder which engages said shoulder on said first glide member; and means securing said metal cap to said first glide member.

24. The modular seating system of claim 23 wherein said metal cap includes a downwardly opening cavity in the bottom thereof adapted to receive the head of a screw;

a hole extending through said metal cap generally at the base of said cavity whereby the shank of a screw will pass therethrough.

25. The modular seating system of claim 23 in which said first glide member is made of a hard plastic material and said second glide member is made of a soft plastic material.

26. The modular seating system of claim 25 wherein said first glide member is made of a hard plastic material having a Rockwell hardness of from about 60 to about 80 on the "M" Scale; and said second glide member is made of a soft plastic having a durometer of between about 70 and about 100 on the Shore A Scale.

27. The modular seating system of claim 26 wherein said hard plastic material is a polycarbonate and said soft plastic material is a polyethelene-vinyl acetate copolymer.

28. The modular seating system of claim 22 in which said first glide member is made of a hard plastic material and said second glide member is made of a soft plastic material.

29. The modular seating system of claim 28 wherein said first glide member is made of a hard plastic material having a Rockwell hardness of from about 60 to about 80 on the "M" Scale; and said second glide member is made of a soft plastic having a durometer of between about 70 and about 100 on the Shore A Scale.

30. The modular seating system of claim 29 wherein said hard plastic material is a polycarbonate and said soft plastic material is a polyethelene-vinyl acetate copolymer.

31. A furniture glide having means for securing same to an article of furniture and comprising:

a first glide member made of a hard, rigid structural material capable of supporting an article of furniture in various use modes including sliding without significant deformation;

said first glide member including a downwardly opening cavity therein and defining a downwardly facing shoulder around said cavity;

said shoulder having inner and outer radiused bottom edges, said inner bottom edge being contiguous with said cavity and said outer bottom edge being spaced outwardly therefrom whereby said first glide member will not dig into a floor surface and can function as a glide in and of itself;

a second glide member secured to said first glide member and seated within said cavity and projecting a short distance below said shoulder of said first glide member at least when said furniture glide is unweighted;

said second glide member being of a relatively soft, high friction material which will tend to prevent an article of furniture employing said glide from sliding over a surface on which it is located;

a metal cap having rounded bottom edges whereby said metal cap will not gouge a floor on which it is seated;

said metal cap fitting over said projecting portions of said second glide member;

said metal cap including a top shoulder which engages said shoulder on said first glide member; and means securing said metal cap to said first glide member.

32. A modular seating furniture system comprising at least two articles of seating designed for location in immediate adjacency to one another;

each of said articles of seating being free of ganging means for joining same together;

each article of furniture including glide means having a protruding, soft, high friction glide member for engaging the surface on which said articles of seating are positioned to prevent same from sliding relative to one another;

said glide means comprises a plurality of furniture glides on each said article of seating, each of said glides comprising:

a first glide member made of a hard, rigid structural material capable of supporting an article of furniture in various use modes including sliding without significant deformation;

said first glide member including a downwardly opening cavity therein and defining a downwardly facing shoulder around said cavity;

said shoulder having inner and outer radiused bottom edges, said inner bottom edge being contiguous with said cavity and said outer bottom edge being spaced outwardly therefrom whereby said first glide member will not dig into a floor surface and can function as a glide in and of itself;

a second glide member secured to said first glide member and seated within said cavity and projecting a short distance below said shoulder of said first glide member at least when said furniture glide is unweighted;

said second glide member being made of a relatively soft, high friction material which will tend to prevent an article of furniture employing said glide from sliding over a surface on which it is located;

a metal cap having rounded bottom edges whereby said metal cap will not gouge a floor on which it is seated;

said metal cap fitting over said projecting portions of said second glide member;

said metal cap including a top shoulder which engages said shoulder on said first glide member; and means securing said metal cap to said first glide member.

* * * * *

UNITED STATES PATENT AND TRADEMARK OFFICE

CERTIFICATE OF CORRECTION

PATENT NO. : 4,327,461
DATED : May 4, 1982

INVENTOR(S) : Joseph M. Wisniewski

It is certified that error appears in the above—identified patent and that said Letters Patent is hereby corrected as shown below:

Column 4, line 42:
"slide" should be --glide--

Column 5, line 5:
"interpretted" should be --interpreted--

Column 5, Claim 1, line 43:
"membes" should be --members--

Column 5, line 50 (Claim 2):
"compressable" should be --compressible--

Column 7, line 23 (Claim 17):
"compressable" should be --compressible--

Signed and Sealed this

*Thirteenth* Day of *July 1982*

[SEAL]

*Attest:*

GERALD J. MOSSINGHOFF

*Attesting Officer*

*Commissioner of Patents and Trademarks*